US010826221B2

(12) United States Patent
Chiba et al.

(10) Patent No.: US 10,826,221 B2
(45) Date of Patent: Nov. 3, 2020

(54) CONNECTOR WITH FLEXIBLE LOCK PIECE

(71) Applicant: YAZAKI CORPORATION, Tokyo (JP)

(72) Inventors: Shingo Chiba, Shizuoka (JP); Naokazu Nagasaka, Shizuoka (JP); Dacheng Jin, Shizuoka (JP); Atsuhito Saito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/417,558

(22) Filed: May 20, 2019

(65) Prior Publication Data

US 2019/0393639 A1 Dec. 26, 2019

(30) Foreign Application Priority Data

Jun. 21, 2018 (JP) ..... 2018-118033

(51) Int. Cl.
*H01R 13/40* (2006.01)
*H01R 13/422* (2006.01)
*H01R 13/11* (2006.01)
*H01R 4/18* (2006.01)

(52) U.S. Cl.
CPC ..... *H01R 13/4223* (2013.01); *H01R 13/11* (2013.01); *H01R 4/185* (2013.01)

(58) Field of Classification Search
CPC ..... H01R 13/4223; H01R 13/4362
USPC ..... 439/595, 752, 752.5
See application file for complete search history.

(56) References Cited

U.S. PATENT DOCUMENTS 4,124,264 A * 11/1978 Kato ..... H01R 13/4223 439/595
5,562,495 A 10/1996 Kakitani et al.
6,244,900 B1 * 6/2001 Ishikawa ..... H01R 13/4223 439/595
6,623,313 B1 * 9/2003 Ichida ..... H01R 13/113 439/595

(Continued)

FOREIGN PATENT DOCUMENTS

JP 8-130058 A 5/1996
JP 2004-14503 A 1/2004

(Continued)

*Primary Examiner* — Thanh Tam T Le
(74) *Attorney, Agent, or Firm* — Kenealy Vaidya LLP

(57) ABSTRACT

A connector includes a terminal including an electric contact portion having a lock end edge at a rear end thereof in an insertion direction and a wire connection portion having a core wire caulked portion; a housing having an insertion opening on a rear end surface thereof and a terminal accommodation chamber to accommodate the terminal inserted from the insertion opening; a flexible lock piece integrally formed with the housing and having a lock surface locking the lock end edge of the terminal inserted into the terminal accommodation chamber; an inclined surface formed on the flexible lock piece, pressed by the terminal during insertion, and moving the lock surface in an unlocking direction; and a recessed clearance portion formed on the inclined surface and having a bottom surface located farther from the core wire caulked portion of the insertion-completed terminal and the vicinity thereof than the inclined surface.

7 Claims, 8 Drawing Sheets

(56) References Cited

U.S. PATENT DOCUMENTS

| | | | | |
|---|---|---|---|---|
| 6,790,085 | B2 * | 9/2004 | Nankou | H01R 13/4223 439/595 |
| 6,796,836 | B2 * | 9/2004 | Ichida | H01R 13/113 439/595 |
| 6,948,986 | B2 * | 9/2005 | Kojima | H01R 13/4223 439/595 |
| 6,953,366 | B2 * | 10/2005 | Fukatsu | H01R 13/4223 439/595 |
| 7,014,505 | B1 | 3/2006 | Tanaka et al. | |
| 7,311,561 | B2 * | 12/2007 | Anbo | H01R 4/185 439/752.5 |
| 2006/0063427 | A1 | 3/2006 | Tanaka et al. | |
| 2013/0267123 | A1 | 10/2013 | Matsumura et al. | |

FOREIGN PATENT DOCUMENTS

| | | | |
|---|---|---|---|
| JP | 2005-259363 | A | 9/2005 |
| JP | 2007-95395 | A | 4/2007 |
| JP | 2012-134010 | A | 7/2012 |

* cited by examiner

CONNECTOR WITH FLEXIBLE LOCK PIECE

CROSS-REFERENCE TO RELATED APPLICATIONS

This application is based on and claims priority under 35 USC 119 from Japanese Patent Application No. 2018-118033 filed on Jun. 21, 2018, the contents of which are incorporated herein by reference.

TECHNICAL FIELD

The present invention relates to a connector.

BACKGROUND ART

In a connector in which a terminal is mounted to a resin housing, an accommodation chamber (terminal accommodation chamber) is formed in the housing, and the terminal is locked and retained by a lance (flexible lock piece) provided in the accommodation chamber. (See, for example, Patent Literatures 1 and 2).

For example, in a connector 501 disclosed in Patent Literature 2 shown in FIG. 8, an accommodation chamber 505 is included in a housing 503. An insertion opening 507 that opens the accommodation chamber 505 to the outside is formed at a rear end of the accommodation chamber 505. The accommodation chamber 505 includes a band 511 on a portion of an upper inner wall 509. A front end connecting plate portion 513 and a rear end connecting portion 515 are supported on the band 511, and an intermediate portion 517 is thus in a floating state. A lance 521 protruding toward a lower inner wall 519 is formed integrally with the intermediate portion 517. A lock surface 523 is formed at a front end of the lance 521. Meanwhile, a box portion 527 that covers a terminal contact spring is formed at a front end of a terminal 525. A core wire caulked portion 529 is formed in an intermediate portion of the terminal 525. A recessed portion 531, which is recessed below upper ends of the box portion 527 and the core wire caulked portion 529, is formed between the box portion 527 and the core wire caulked portion 529.

When the terminal 525 is inserted, with the box portion 527 serving as a head, into the accommodation chamber 505 from the insertion opening 507, a front end of the box portion 527 abuts against a chamfer 533 of the lance 521 and pushes up the lance 521. That is, the terminal 525 elastically deforms the band 511. When the box portion 527 of the band 511 exceeds the lance 521, pushing of the box portion 527 is released and the band is thus restored. Accordingly, the lance 521 enters the recessed portion 531 of the terminal 525. As a result, the connector 501 is in a locked state in which the lock surface 523 of the lance 521 locks a locked surface 535 provided on a rear end surface of the box portion 527.

PRIOR ART DOCUMENT

Patent Document

Patent Literature 1: JP-A-2004-14503
Patent Literature 2: JP-A-2012-134010.

SUMMARY OF INVENTION

However, since the core wire caulked portion 529 is close to the lance 521 in the connector 501, an engagement margin of the lock surface 523 with respect to the locked surface 535 of the terminal 525 may become shallow, and a terminal holding force may decrease when the core wire caulked portion 529 interferes with the lance 521. Since it is easy for the core wire caulked portion 529 to interferes with the lance 521, a large shear length T, which is responsible for a locking strength of the lock surface 523, cannot be ensured, and the terminal holding force is difficult to be improved.

The present invention is proposed in view of the above circumstances, and an object of the present invention is to provide a connector capable of making it difficult for the core wire caulked portion to interfere with the flexible lock piece, so as to prevent a decrease in the terminal holding force.

The object of the present invention is achieved by the following configuration.

(1) A connector includes: a terminal includes an electric contact portion and a wire connection portion, the electric contact portion having a lock end edge at a rear end thereof in an insertion direction, and the wire connection portion having a core wire caulked portion behind the electric contact portion with a recessed portion provided therebetween; a resin housing that has an insertion opening on a rear end surface thereof to mount the terminal and a terminal accommodation chamber to accommodate the terminal inserted from the insertion opening; a flexible lock piece that is integrally formed with the housing, and has a lock surface that locks the lock end edge of the terminal inserted into the terminal accommodation chamber to prevent the terminal from slipping out; an inclined surface that is formed on the flexible lock piece, pressed by the terminal during insertion, and moves the lock surface in an unlocking direction; and a recessed clearance portion that is formed on the inclined surface, and has a bottom surface located farther from the core wire caulked portion of the insertion-completed terminal and the vicinity thereof than the inclined surface.

According to the connector having the configuration (1), a recessed clearance portion is formed on the inclined surface of the flexible lock piece to reduce interference of the core wire caulked portion and the vicinity thereof. The recessed clearance portion is formed in a manner that the bottom surface is farther from the core wire caulked portion and the vicinity thereof than the inclined surface. That is, the recessed clearance portion is an entry space allowing entry of the core wire caulked portion and the vicinity thereof. Accordingly, it is difficult for the core wire caulked portion and the vicinity thereof to interfere with the inclined surface even when processing accuracy of the core wire caulked portion has irregularities. As a result, the decrease in the terminal holding force is reduced. Since the recessed clearance portion is formed on the flexible lock piece, a clearance can be ensured between the core wire caulked portion and the vicinity thereof and the inclined surface as compared with a prior art structure. The flexible lock piece is substantially orthogonal to the lock surface, and a cross section of the flexible lock piece that is substantially parallel to a terminal drawing direction has a shear length which is easy for a shear fracture to occur. Since the clearance between the core wire caulked portion and the vicinity thereof and the inclined surface is increased due to the recessed clearance portion, the shear length can be ensured to be large. As a result, the flexible lock piece can improve the terminal holding force by increasing the shear length of the lock surface and increasing the locking strength.

(2) The connector according to (1), in which a pair of protruding line portions is formed on a recessed portion opposite surface of the flexible lock piece opposite to the recessed portion, the protruding line portions extend from the lock surface over the inclined surface and protrude toward the recessed portion.

According to the connector having the configuration (2), a pair of protruding line portions is formed on the recessed portion opposite surface of the flexible lock piece. Each of the pair of protruding line portions extends from the lock surface over the inclined surface along both sides of the recessed portion opposite surface. A tip end surface of the protruding line portion is on the same plane as the lock surface. A rear portion of the protruding line portion protrudes high on the inclined surface. When the shear fracture occurs, a starting end of a shear surface serves as the lock surface. Meanwhile, a terminal end of the shear surface serves as the inclined surface. Since the pair of protruding line portions protrudes high on this inclined surface, the pair of protruding line portions remains as unbroken portions even when the inclined surface is broken. That is, the shear length can be improved. As a result, the connector can increase the shear length and improve the terminal holding force, as compared with a case where the protruding line portions are not provided.

(3) The connector according to (2), in which a lock protrusion is disposed on the lock end edge between the pair of protruding line portions, the lock protrusion protrudes from the lock end edge toward the flexible lock piece to increase an engagement margin between the lock protrusion and the lock surface.

According to the connector having the configuration (3), a contact region of the lock surface of the flexible lock piece, which is locked to the lock end edge of the terminal, serves as the engagement margin. Here, the lock protrusion is further formed, which protrudes from the lock end edge of the terminal toward the flexible lock piece. The contact region of the flexible lock piece increases as the lock protrusion comes into contact with the lock surface. As a result, the connector can increase the engagement margin and improve the terminal holding force, as compared with a case where the lock protrusion is not provided. Since the lock protrusion is formed between the pair of protruding line portions, interference with the protruding line portions can be avoided. Therefore, a retraction stroke of the flexible lock piece when the terminal is inserted can be reduced as compared with a case where the protruding line portions are interfered and enlargement of a size of the housing can be prevented.

(4) The connector according to any one of (1) to (3), in which the core wire caulked portion and the vicinity thereof include a bell mouth of the core wire caulked portion and a core wire protruding portion protruding from the bell mouth.

According to the connector having the configuration (4), the core wire caulked portion and the vicinity thereof include the bell mouth of the core wire caulked portion and the core wire protruding portion protruding from the bell mouth. Generally, the core wire protruding portion protrudes from the core wire caulked portion. Front and rear ends of the core wire caulked portion are diameter-expanded in a tapered shape to serve as the bell mouth, so as to avoid damage to a core wire and the like. Processing accuracy of the core wire protruding portion and the bell mouth is likely to have irregularities. In the connector, it is possible to avoid interference with the inclined surface more effectively by arranging the recessed clearance portion to be opposite to the core wire protruding portion or the bell mouth whose processing accuracy is particularly easy to have irregularities.

According to the connector of the invention, it is possible to prevent the decrease in the terminal holding force by making it difficult for the core wire caulked portion to interfere with the flexible lock piece.

The invention is briefly described above. Details of the invention will be further clarified by reading through a mode described below for implementing the invention (hereinafter, referred to as an "embodiment") with reference to accompanying drawings.

DESCRIPTION OF EMBODIMENTS

Embodiments of the present invention will be described below with reference to the drawings.

Figure 1:
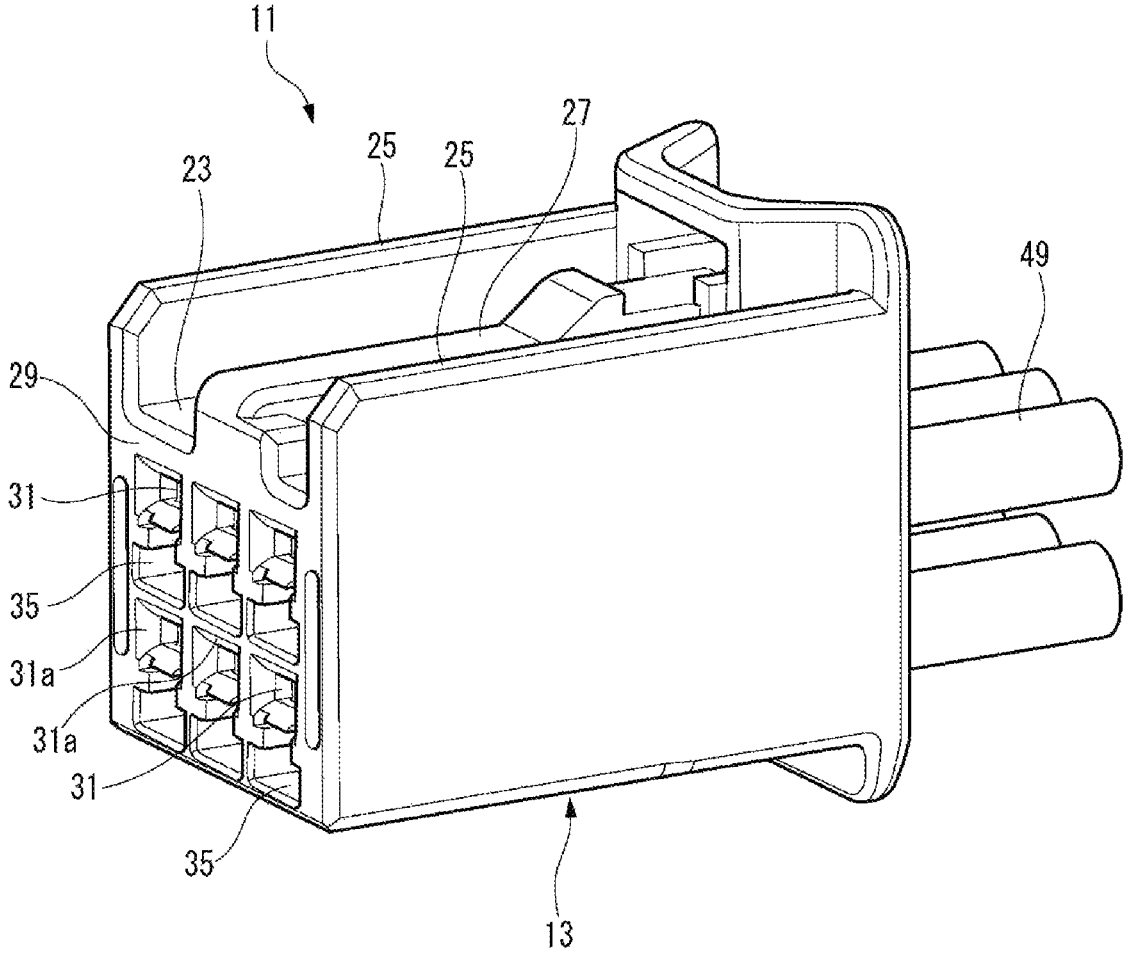
FIG. 1 is a perspective view of a connector according to an embodiment of the invention viewed obliquely above a front side.

FIG. 1 is a perspective view of a connector 11 according to an embodiment of the invention viewed obliquely above a front side. Main configurations of the connector 11 according to the present embodiment include a housing 13, a terminal 15, a flexible lock piece 17, an inclined surface 19, and a recessed clearance portion 21.

In the connector 11, the resin housing 13 is formed in a substantially rectangular parallelepiped shape by injection-molding an electrically insulating synthetic resin material. A pair of parallel guide walls 25 serving as guides when the connector 11 couples with a mating connector (not shown), and a lock arm 27 formed between the pair of guide walls 25 to lock a coupling state are formed on an upper surface of an upper wall portion 23 of the connector 11. A plurality of (six in the present embodiment, horizontally three rows and vertically two columns) mating terminal entry openings 31 are opened in a front end surface 29 of the housing 13 in a coupling direction.

Figure 2:
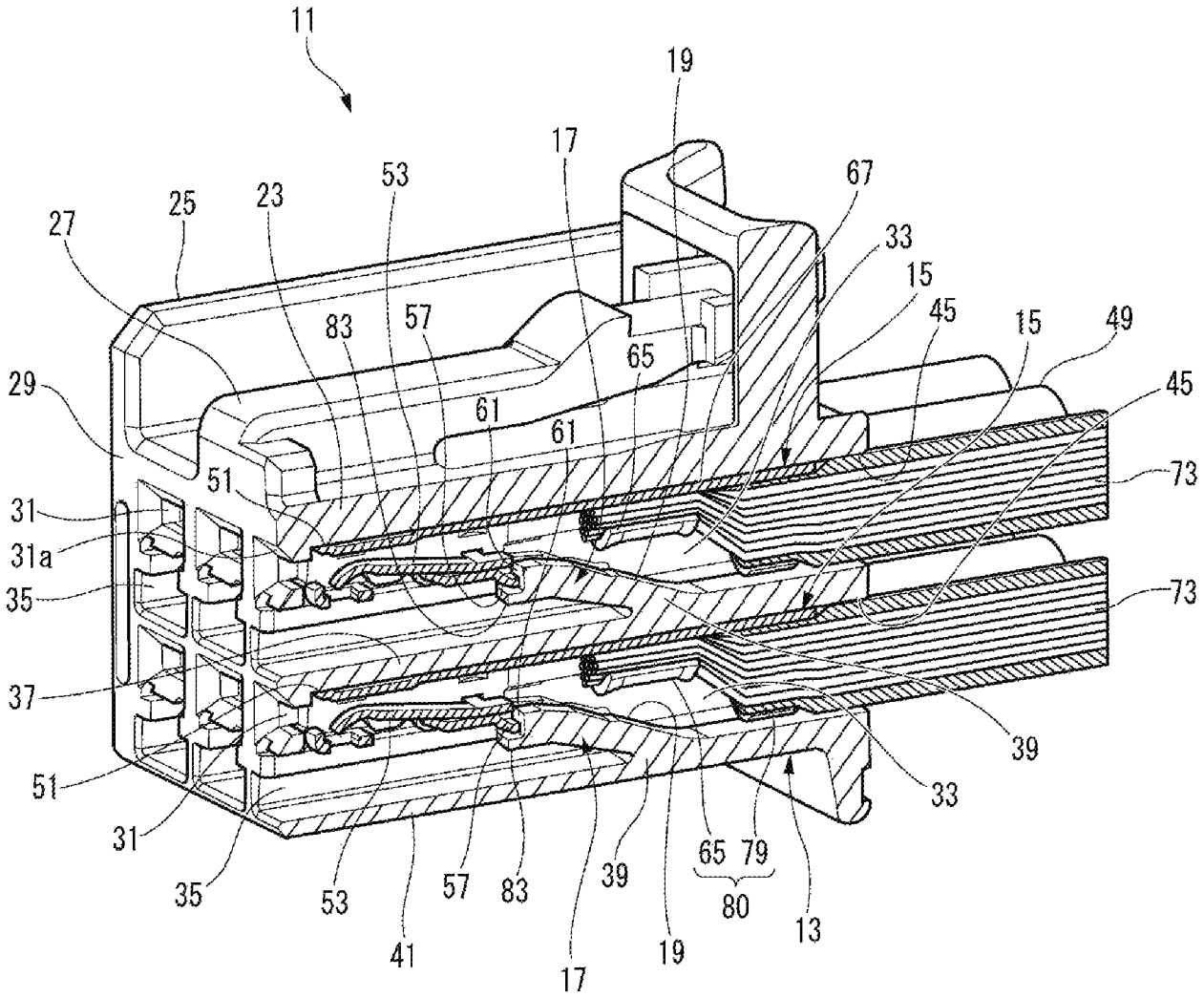
FIG. 2 is a perspective view of a cross section of a side portion of the connector shown in FIG. 1.

FIG. 2 is a perspective view of a cross section of a side portion of the connector 11 shown in FIG. 1.

Totally six terminal accommodation chambers 33 (horizontally three rows and vertically two columns), where the terminal 15 is mounted, are formed inside the housing 13. A tip end of each terminal accommodation chamber 33 is opened through the mating terminal entry opening 31. A tapered surface 31*a* that guides entry of a mating terminal (not shown) is formed in the mating terminal entry opening 31 so as to be tapered toward the terminal accommodation chamber 33.

In the present embodiment, the mating terminal is a male terminal including a rod-like electric contact portion. The mating connector is a male connector where the male terminal is mounted. The connector 11 of the present embodiment is a female connector coupled to the male connector. Therefore, the terminal 15 described below mounted on the connector 11 is a female terminal.

A horizontal hole portion 35 extending rearward from a tip end surface is formed in the housing 13 below each terminal accommodation chamber 33 and along the terminal accommodation chamber 33. A part of the horizontal hole portion 35 communicates with the terminal accommodation chamber 33. The flexible lock piece 17, which will be described below, protrudes from each of the terminal accommodation chambers 33. A deep side of the horizontal hole portion 35 serves as a retraction space when the flexible lock piece 17 moves in an unlocking direction (downward direction in the figure).

When the flexible lock piece 17 enters the retraction space, the terminal 15 can be unlocked. Therefore, the horizontal hole portion 35 can be used as an insertion space for a regulation rod (not shown) that doubly retains the terminal 15 through restricting movement of the flexible lock piece 17. The horizontal hole portion 35 can be used as an unlocking hole that enables insertion of a release tool for twisting the flexible lock piece 17 in the unlocking direction to unlock the terminal 15.

Figure 3:
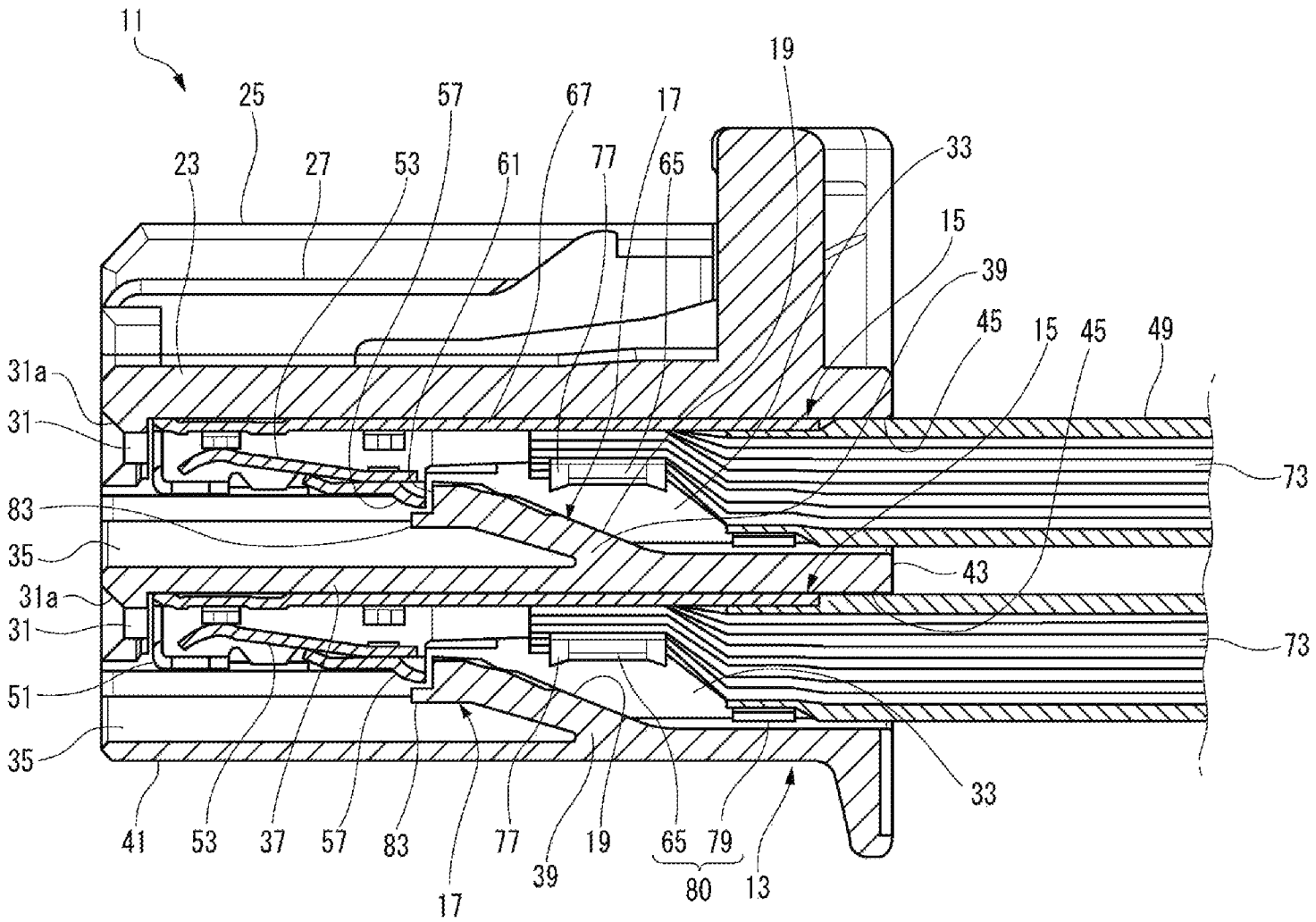
FIG. 3 is a longitudinal sectional view of the connector shown in FIG. 1.

FIG. 3 is a longitudinal sectional view of the connector 11 shown in FIG. 1.

In the housing 13, the terminal accommodation chamber 33 and the horizontal hole portion 35 on an upper side, and the terminal accommodation chamber 33 and the horizontal hole 35 on an lower side, are vertically partitioned by a horizontal partition wall portion 37. A base end 39 of the flexible lock piece 17 is connected to an upper surface of the horizontal partition wall portion 37 and is integrally formed with the upper surface. The base end 39 of the flexible lock piece 17 protruding to the lower side terminal accommodation chamber 33 is connected to a bottom wall portion 41 of the housing 13 and is integrally formed with the bottom wall portion 41.

Figure 4:
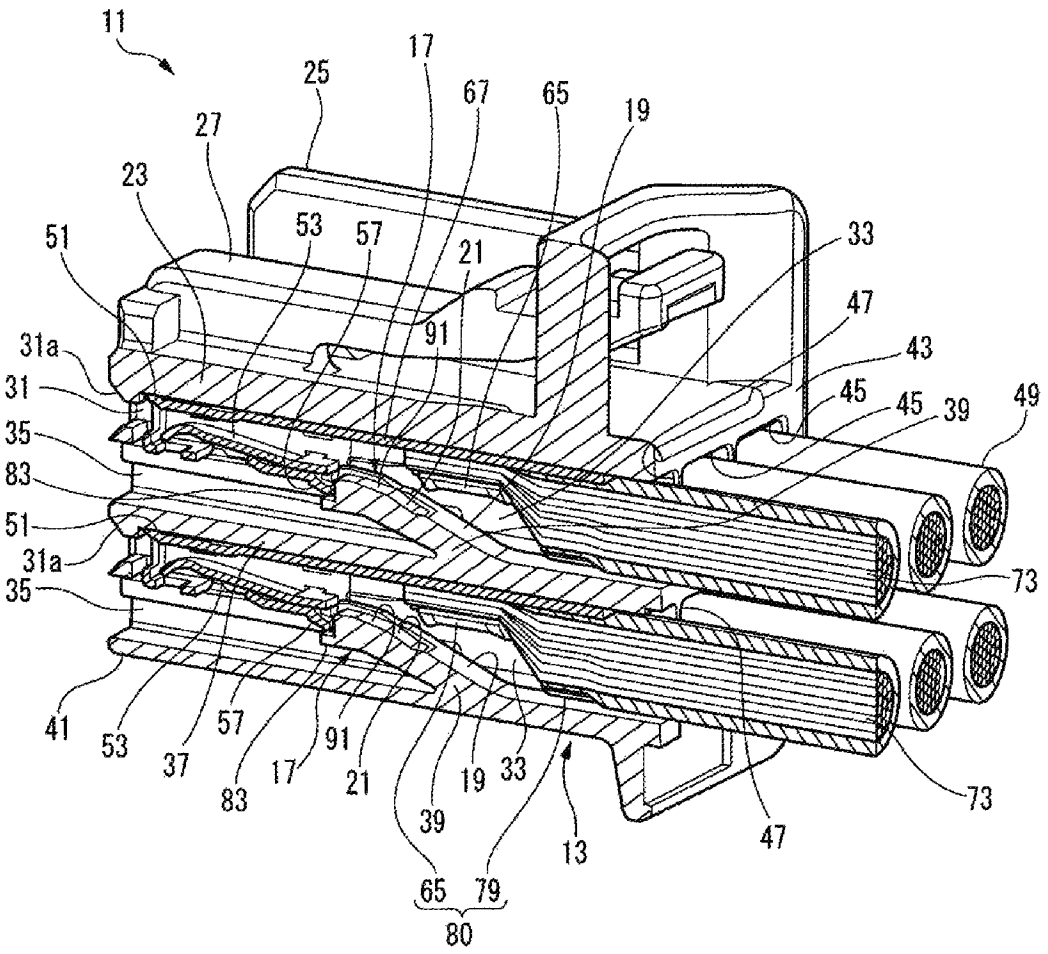
FIG. 4 is a perspective view of the cross section of the side portion of the connector shown in FIG. 1 viewed obliquely above a rear side.

FIG. 4 is a perspective view of the cross section of the side portion of the connector 11 shown in FIG. 1 viewed obliquely above a rear side.

An insertion opening 45 for mounting the terminal 15 in the terminal accommodation chamber 33 is opened in a rear end surface 43 of the housing 13. The insertion opening 45 communicates with each of the terminal accommodation chambers 33. That is, totally six insertion openings 45 are opened (horizontally three rows and vertically two columns). Each of the insertion openings 45 is vertically partitioned by the horizontal partition wall portion 37, and horizontally partitioned by two parallel vertical partition wall portions 47 to form six quadrangular holes. The terminal 15 is inserted through the insertion opening 45 and held in the terminal accommodation chamber 33. The number of the terminal accommodation chambers 33 is not limited to six. The connector 11 may have only one terminal accommodation chamber 33, or may have a plurality of terminal accommodation chambers 33 other than six.

Figure 5A:
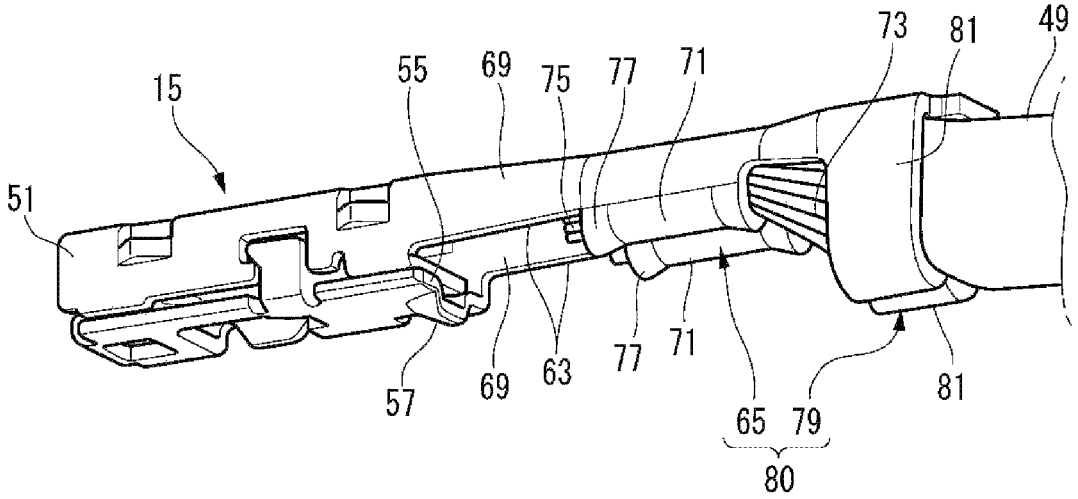
FIG. 5A is a perspective view of a terminal attached to an end of an electric wire.
Figure 5B:
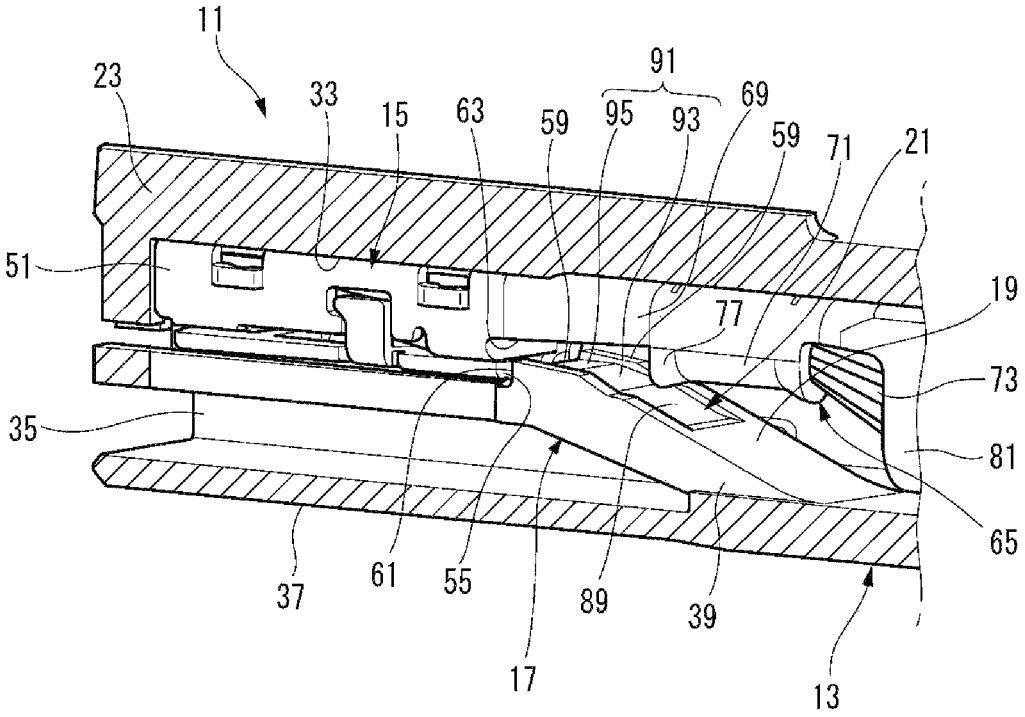
FIG. 5B is a main portion perspective view of a cross section of a side portion of a terminal accommodation chamber where the terminal is mounted.

FIG. 5A is a perspective view of the terminal 15 attached to an end of an electric wire 49, and FIG. 5B is a main portion perspective view of a cross section of a side portion of the terminal accommodation chamber 33 where the terminal 15 is mounted.

The terminal 15 is formed by pressing a metal plate. The terminal 15 includes an electric contact portion 51 at a tip end in an insertion direction. In the present embodiment, since the terminal 15 is a female terminal, the electric contact portion 51 is formed in a box shape. A spring piece portion 53 (see FIG. 4 for example) that contacts the mating terminal to conduct electricity is bent and integrally formed inside the box-shaped electric contact portion 51.

A lock end edge 55 is formed at a rear end of the electric contact portion 51 in the insertion direction. The lock end edge 55 is an axis direction rear end of a flat metal blank plate in an extended state, which is bent into an angular cylindrical shape. As for the lock end edge 55, ends on both sides of the bent angular cylindrical shaped metal blank plate in a bending direction are doubly overlapped in a vertical direction.

In the present embodiment, a protruding lock protrusion 57 is further formed on the doubly overlapped outer end of the metal blank plate. The lock protrusion 57 has an outer shape in which a substantially quadrangular pyramid is halved by a cross section passing through a vertex. A bottom surface side of the lock protrusion 57 is on the same plane as the lock end edge 55. The lock protrusion 57 is disposed between a pair of protruding line portions 59 formed on the flexible lock piece 17, which will be described below. The lock protrusion 57 protrudes from the lock end edge 55 toward the flexible lock piece 17, thereby increasing an engagement margin between the lock protrusion 57 and a lock surface 61 provided on the flexible lock piece 17 which will be described below.

The terminal 15 is provided with a core wire caulked portion 65 of a wire connection portion 80 behind the lock end edge 55 provided in the electric contact portion 51 with a recessed portion 63 provided therebetween. The recessed portion 63 is formed by cutting a pair of bent side plate portions 69, erected from both side edges of a bottom plate portion 67 (see FIG. 3) of the terminal 15, into a recessed shape toward the bottom plate portion 67. The core wire caulked portion 65 includes a pair of caulking pieces 71 extending from the side plate portions 69 on both sides in an erecting direction. Each caulking piece 71 of the core wire caulked portion 65 is crimped by plastically deforming a bundle of core wires 73 formed of a plurality of stranded wires so as to make the bundle wound from both sides. A cover caulked portion 79, which constitutes the wire connection portion 80 with the core wire caulked portion 65, is formed behind the core wire caulked portion 65. The cover caulked portion 79 includes a pair of cover caulking pieces 81. The pair of cover caulking pieces 81 are plastically deformed and caulked so as to surround a terminal end of the electric wire 49 from both sides.

A tip end of the core wire 73 protrudes toward the recessed portion 63 in the core wire caulked portion 65. The protruding core wire 73 serves as a core wire protruding portion 75. The core wire caulked portion 65 is formed as a bell mouth 77 whose front and rear ends gradually expand toward a tip end. Since the core wire caulked portion 65 is provided with the core wire protruding portion 75 and the bell mouth 77, a predetermined crimping performance is ensured.

In the present embodiment, the core wire caulked portion 65 and the vicinity thereof include: a bell mouth 77 located on the side of the core wire protruding portion 75 of the core wire caulked portion 65; and the core wire protruding portion 75 protruding from the bell mouth 77.

The flexible lock piece 17 is integrally formed with the housing 13 and protrudes into the terminal accommodation chamber 33. In the present embodiment, the base end 39 of the flexible lock piece 17 is connected to the horizontal partition wall portion 37 or the bottom wall portion 41 and is integrally formed with the horizontal partition wall portion 37 or the bottom wall portion 41. The base end 39 of the flexible lock piece 17 is supported by a housing side, and a tip end of the flexible lock piece 17 is a free end. The flexible lock piece 17 is pressed by the terminal 15 during insertion to elastically deform in the unlocking direction. The flexible lock piece 17 is elastically restored after the insertion of the terminal 15. The flexible lock piece 17 includes a lock surface 61 that locks the lock end edge 55 of the inserted terminal 15 and prevents the terminal 15 from slipping off.

Figure 8:
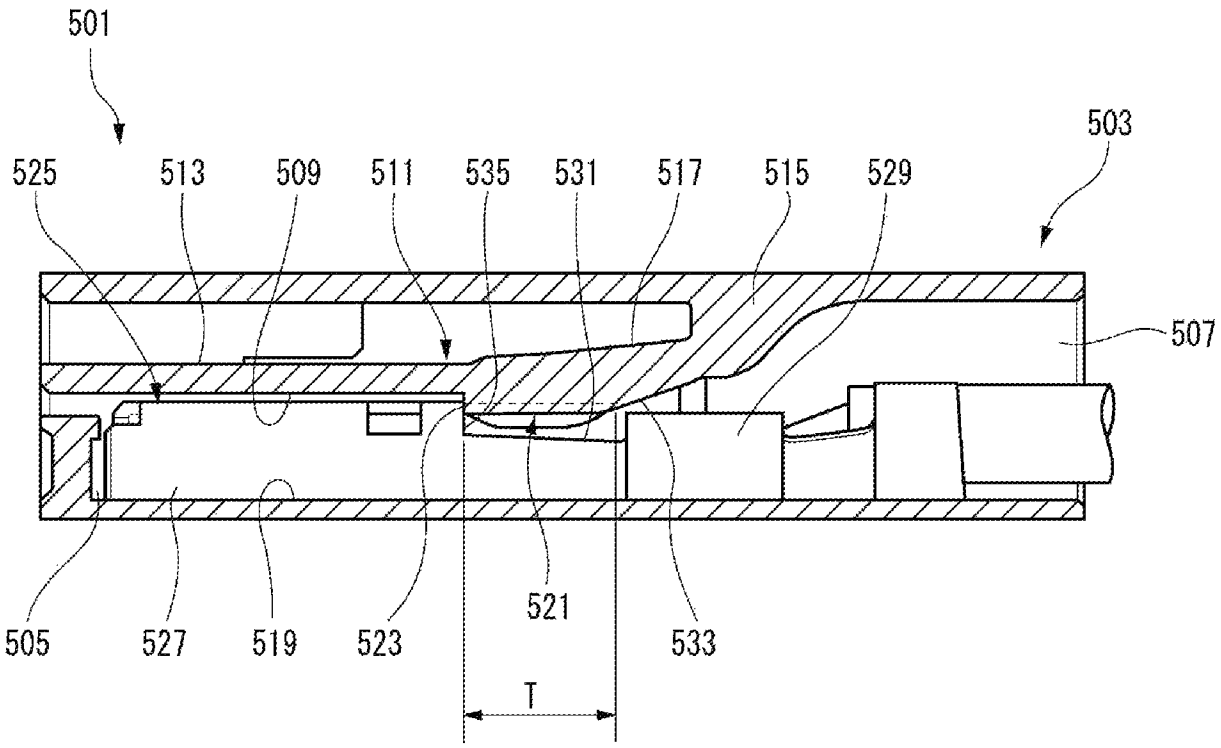
FIG. 8 is a sectional side view of a prior art connector in which a terminal is mounted in a terminal accommodation chamber.

In the present embodiment, the flexible lock piece 17 is formed in a cantilevered shape in which only the base end 39 is connected to the housing 13, but the invention is not limited thereto. As disclosed in prior art shown in FIG. 8, the flexible lock piece 17 may be integrally formed with a double-supported beam-like band. A front end connecting plate portion and a rear end connecting portion of the band are supported by the housing 13, and an intermediate portion of the band is in a floating state.

Figure 6:
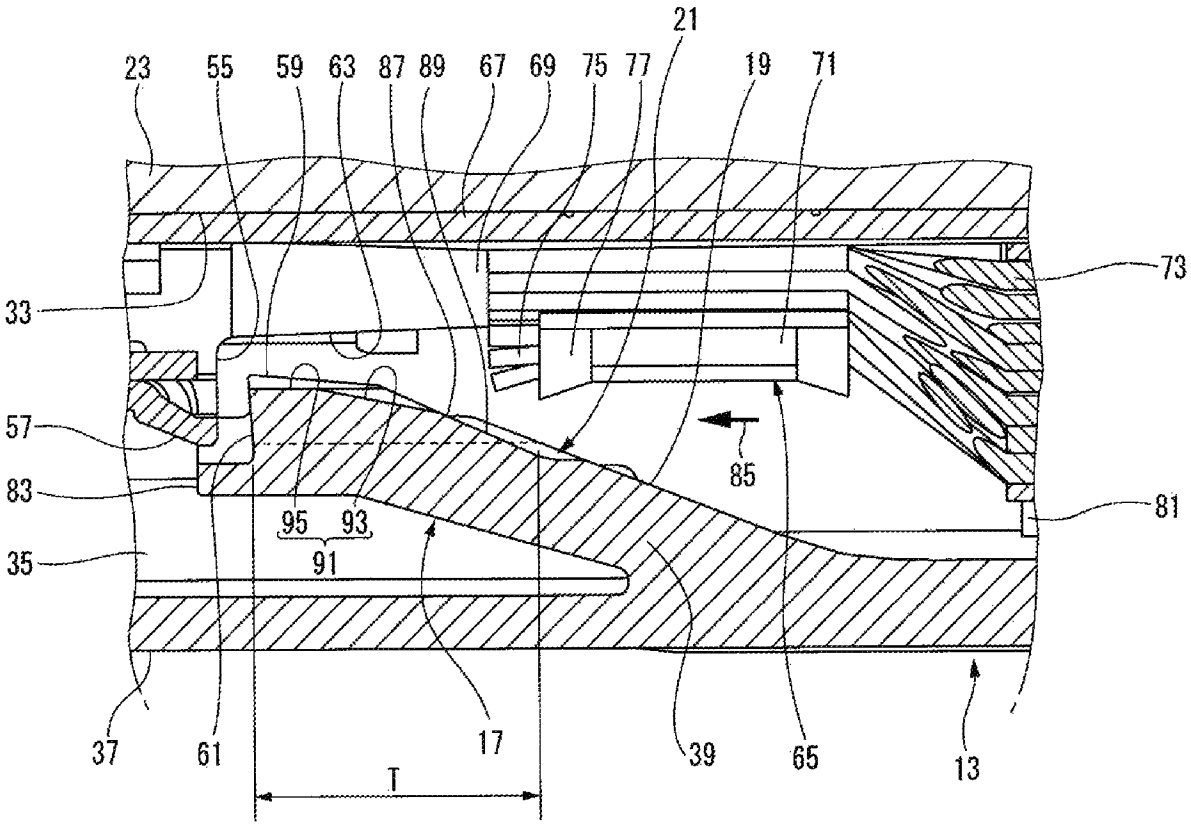
FIG. 6 is a main portion enlarged view of a flexible lock piece shown in FIG. 3.

FIG. 6 is a main portion enlarged view of the flexible lock piece 17 shown in FIG. 3.

The lock surface 61 is formed at the tip end of the flexible lock piece 17 on a plane substantially orthogonal to the insertion direction of the terminal 15. A tip end protruding portion 83 is formed at the tip end of the flexible lock piece 17 on a side of the lock surface 61 opposite to the terminal 15. Therefore, the tip end of the flexible lock piece 17 is formed in an L shape when viewed in a side cross section. The tip end protruding portion 83 can be used as an unlocking portion that is twisted by the release tool inserted into the horizontal hole portion 35.

A surface of the flexible lock piece 17 opposite to the insertion opening 45 serves as the inclined surface 19. The inclined surface 19 is an upwardly inclined surface that gradually enters the terminal accommodation chamber 33 toward a front of the terminal accommodation chamber 33. The inclined surface 19 blocks a part of an entry path 85 of the terminal 15 inserted through the insertion opening 45. Accordingly, the inclined surface 19 is pressed by the electric contact portion 51 during insertion, and the lock surface 61 is moved in the unlocking direction (downward direction in FIG. 6).

A recessed clearance portion 21 is formed on the inclined surface 19. The recessed clearance portion 21 is formed by cutting the inclined surface 19 into a quadrangular shape. The recessed clearance portion 21 has a quadrangular bottom surface 89 to which a front side portion 87 on the side of the lock surface 61 is connected. The front side portion 87 is on the same plane as the inclined surface 19. The bottom surface 89 is oppositely disposed to the core wire caulked portion 65 of the inserted terminal 15 and the vicinity thereof. Since the recessed clearance portion 21 is cut out, the bottom surface 89 is farther from the core wire caulked portion 65 and the vicinity thereof than the inclined surface 19. That is, since the recessed clearance portion 21 is provided on the inclined surface 19, clearance between the flexible lock piece 17 and the core wire caulked portion 65 and the vicinity thereof is expanded.

Figure 7:
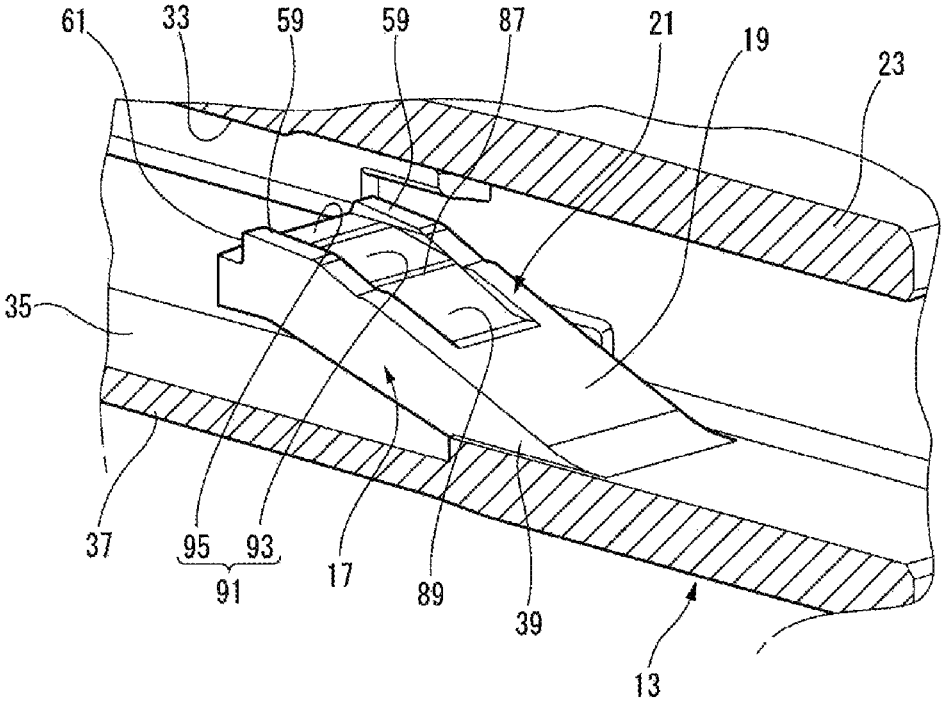
FIG. 7 is a main portion enlarged view of the flexible lock piece viewed obliquely above a rear side.

FIG. 7 is a main portion enlarged view of the flexible lock piece 17 viewed obliquely above a rear side.

A portion of the flexible lock piece 17 opposite to the recessed portion 63 of the terminal 15 serves as a recessed portion opposite surface 91. The recessed portion opposite surface 91 is continuous with the bottom surface 89 of the recessed clearance portion 21. The recessed portion opposite surface 91 includes a connection inclined surface 93 continuous with the front side portion 87 of the bottom surface 89, and an opposite flat surface 95 continuous on a side of the connection inclined surface 93 opposite to the bottom surface 89. Inclination angles of the bottom surface 89, the connection inclined surface 93, and the opposite flat surface 95 decrease in this order.

The pair of parallel protruding line portions 59 are formed on both sides of the flexible lock piece 17 over the opposite flat surface 95 and the connection inclined surface 93. The pair of protruding line portions 59 extends from the lock surface 61 over the inclined surface 19 and protrudes toward the recessed portion 63 of the terminal 15.

Next, functions of the above configurations will be described.

In the connector 11 according to the present embodiment, the flexible lock piece 17 protrudes into the terminal accommodation chambers 33 of the housing 13 and is integrally formed with the terminal accommodation chambers 33. The inclined surface 19 is formed on the flexible lock piece 17 toward the insertion direction in which the terminal 15 enters the terminal accommodation chamber 33. During an insertion process, the electric contact portion 51 located at the tip end of the terminal 15 presses the inclined surface 19 and elastically deforms the flexible lock piece 17 toward the unlocking direction. The terminal 15 which elastically deforms the flexible lock piece 17 is in sliding contact with the flexible lock piece 17 while entering the terminal accommodation chamber 33. The lock end edge 55 coincides with the lock surface 61 of the flexible lock piece 17 after the terminal 15 is inserted to a predetermined position. The lock surface 61 is substantially parallel to a direction in which the flexible lock piece 17 is elastically restored. That is, the lock surface 61 is substantially orthogonal to a removal direction of the terminal 15. The terminal 15 is held in the terminal accommodation chamber 33 by disposing the lock surface 61 oppositely to a rear side of the lock end edge 55.

When the terminal 15 is held in the terminal accommodation chamber 33, the core wire caulked portion 65 and the vicinity thereof are opposite to the inclined surface 19. When the flexible lock piece 17 is pressed by the inclined surface 19 in the same manner as in the insertion process of the terminal 15, the lock surface 61 moves in the unlocking direction, and the engagement margin locked on the lock end edge 55 of the terminal 15 is reduced.

Meanwhile, the core wire 73 of the electric wire 49 is caulked in the core wire caulked portion 65 of the terminal 15. In order to ensure a crimping length of the core wire caulked portion 65, the tip end of the core wire 73 is extended to form the core wire protruding portion 75. In a crimping processing of the core wire 73 performed through a plastic processing of the core wire caulked portion 65, it is easy for an outer shape to vary due to an elastic reaction force (such as spring back) of each member. In particular, it is easy for outer shapes of the core wire caulked portion 65 and the vicinity thereof to vary. The vicinity of the core wire caulked portion 65 mainly refers to the core wire protruding portion 75. If the core wire caulked portion 65 and the vicinity thereof interfere with the inclined surface 19 due to irregularities of processing accuracy, as described above, the lock surface 61 may move in the unlocking direction and the engagement margin of the flexible lock piece 17 with respect to the lock end edge 55 may be reduced.

Therefore, the recessed clearance portion 21 is formed on the inclined surface 19 of the flexible lock piece 17 of the present embodiment to reduce the interference of the core wire caulked portion 65 and the vicinity thereof. The recessed clearance portion 21 is formed in a manner that the bottom surface 89 is farther from the core wire caulked portion 65 and the vicinity thereof than the inclined surface 19. That is, the recessed clearance portion 21 is an entry space allowing entry of the core wire caulked portion 65 and the vicinity thereof.

Accordingly, it is difficult for the core wire caulked portion 65 and the vicinity thereof to interfere with the inclined surface 19 even when processing accuracy of the core wire caulked portion 65 has irregularities. As a result, the decrease in the terminal holding force is reduced.

Since the recessed clearance portion 21 is formed on the flexible lock piece 17, a clearance can be ensured between the core wire caulked portion 65 and the vicinity thereof and the inclined surface 19 as compared with a prior art structure. The flexible lock piece 17 is substantially orthogonal to the lock surface 61, and a cross section of the flexible lock piece that is substantially parallel to a terminal drawing direction has a shear length T which is easy for a shear fracture to occur. Since the clearance between the core wire caulked portion 65 and the vicinity thereof and the inclined surface 19 is increased due to the recessed clearance portion 21, the shear length T can be ensured to be large. As a result, the flexible lock piece 17 can improve the terminal holding force by increasing the shear length T of the lock surface 61 and increasing the locking strength.

In the connector 11 of the present embodiment, the pair of protruding line portions 59 is formed on the recessed portion opposite surface 91 of the flexible lock piece 17. Each of the pair of protruding line portions 59 extends from the lock surface 61 over the inclined surface 19 along both sides of the recessed portion opposite surface 91. A tip end surface of the protruding line portion 59 is on the same plane as the lock surface 61. A rear portion of the protruding line portion 59 protrudes high on the inclined surface 19. When the shear fracture occurs, a starting end of a shear surface serves as the lock surface 61. Meanwhile, a terminal end of the shear surface serves as the inclined surface 19. Since the pair of protruding line portions 59 protrudes high on this inclined surface 19, the pair of protruding line portions 59 remains as unbroken portions even when the inclined surface 19 is broken. That is, the shear length T can be improved. As a result, the connector 11 can increase the shear length T and further improve the terminal holding force, as compared with a case where the protruding line portions 59 are not provided.

In the connector 11 of the present embodiment, a contact region of the lock surface 61 locked on the lock end edge 55 of the terminal 15 serves as the engagement margin. Here, the lock protrusion 57 is further formed, which protrudes from the lock end edge 55 of the terminal 15 toward the flexible lock piece 17. The contact region of the flexible lock piece 17 increases as the lock protrusion 57 comes into contact with the lock surface 61. As a result, the connector 11 can increase the engagement margin and improve the terminal holding force, as compared with a case where the lock protrusion 57 is not provided. Since the lock protrusion 57 is formed between the pair of protruding line portions 59, interference with the protruding line portions 59 can be avoided. Therefore, in the connector 11, a retraction stroke of the flexible lock piece 17 when the terminal is inserted can be reduced as compared with a case where the protruding line portions 59 interferes with the lock protrusion 57, and enlargement of a size of the housing 13 can be prevented.

Further, in the connector 11 of the present embodiment, the core wire caulked portion 65 and the vicinity thereof include the bell mouth 77 of the core wire caulked portion 65 and the core wire protruding portion 75 protruding from the bell mouth 77. Generally, the core wire protruding portion 75 protrudes from the core wire caulked portion 65. Front and rear ends of the core wire caulked portion 65 are diameter-expanded in a tapered shape to serve as the bell mouth 77, so as to avoid damage to the core wire 73 and the like. Processing accuracy of the core wire protruding portion 75 and the bell mouth 77 is likely to have irregularities. In the connector 11, it is possible to avoid interference with the inclined surface 19 more effectively by arranging the recessed clearance portion 21 to be opposite to the core wire protruding portion 75 or the bell mouth 77 whose processing accuracy is particularly easy to have irregularities.

Therefore, according to the connector 11 of the present embodiment, it is possible to prevent the decrease in the terminal holding force by making it difficult for the core wire caulked portion 65 to interfere with the flexible lock piece 17.

The present invention is not limited to the embodiments described above, and modifications, improvements, and the like can be made as appropriate. In addition, the material, shape, size, number, arrangement position, and the like of each component in the above-described embodiments are optional and are not limited as long as the present invention can be achieved.

Features of the embodiment of the connector according to the invention will be briefly summarized in following [1] to [4].

[1] A connector (11), including:

a terminal (15) that includes an electric contact portion (51) and a wire connection portion (80), the electric contact portion (51) having a lock end edge (55) at a rear end thereof in an insertion direction, and the wire connection portion (80) having a core wire caulked portion (65) behind the electric contact portion (51) with a recessed portion (63) provided therebetween;

a resin housing (13) that has an insertion opening (45) on a rear end surface (43) of the resin housing (13) to mount the terminal, and a terminal accommodation chamber (33) to accommodate the terminal inserted from the insertion opening;

a flexible lock piece (17), integrally formed with the housing, which has a lock surface (61) that locks the lock end edge of the terminal inserted into the terminal accommodation chamber to prevent the terminal from slipping out;

an inclined surface (19), formed on the flexible lock piece, which is pressed by the terminal during insertion and moves the lock surface in an unlocking direction; and a recessed clearance portion (21), formed on the inclined surface, which has a bottom surface (89) located farther from the core wire caulked portion of the insertion-completed terminal and the vicinity thereof than the inclined surface.

[2] The connector according to [1], in which a pair of protruding line portions (59) is formed on a recessed portion opposite surface (91) of the flexible lock piece (17) opposite to the recessed portion (63), the protruding line portions extend from the lock surface (61) over the inclined surface (19) and protrude toward the recessed portion.

[3] The connector according to [2], in which a lock protrusion (57) is disposed on the lock end edge (55) between the pair of protruding line portions (59), the lock protrusion protrudes from the lock end edge toward the flexible lock piece (17) to increase an engagement margin between the lock protrusion and the lock surface (61).

[4] The connector according to any one of [1] to [3], in which the core wire caulked portion (65) and the vicinity thereof include a bell mouth (77) of the core wire caulked portion and a core wire protruding portion (75) protruding from the bell mouth.

What is claimed is:

1. A connector comprising:

a terminal that includes an electric contact portion and a wire connection portion, the electric contact portion having a lock end edge at a rear end thereof in an insertion direction, and the wire connection portion having a core wire caulked portion behind the electric contact portion with a recessed portion provided therebetween;

a resin housing that has an insertion opening on a rear end surface thereof to mount the terminal and a terminal accommodation chamber to accommodate the terminal inserted from the insertion opening;

a flexible lock piece that is integrally formed with the housing, and has a lock surface that locks the lock end edge of the terminal inserted into the terminal accommodation chamber to prevent the terminal from slipping out;

an inclined surface that is formed on the flexible lock piece, pressed by the terminal during insertion, and moves the lock surface in an unlocking direction; and a recessed clearance portion that is formed on the inclined surface, and has a bottom surface located farther from the core wire caulked portion of the insertion-completed terminal and the vicinity thereof than the inclined surface, wherein the bottom surface is oppositely disposed to the core wire caulked portion of the inserted terminal and the vicinity thereof.

2. The connector according to claim 1, wherein a pair of protruding line portions is formed on a recessed portion opposite surface of the flexible lock piece opposite to the recessed portion, and extends from the lock surface over the inclined surface and protrude toward the recessed portion.

3. The connector according to claim 2, wherein a lock protrusion is disposed on the lock end edge between the pair of protruding line portions, and protrudes from the lock end edge toward the flexible lock piece to increase an engagement margin between the lock protrusion and the lock surface.

4. The connector according to claim 1, wherein the core wire caulked portion and a vicinity thereof include a bell mouth of the core wire caulked portion and a core wire protruding portion protruding from the bell mouth.

5. The connector according to claim 1, wherein the core wire caulked portion is disposed between the inclined surface and the bottom surface of the recessed clearance portion along the insertion direction.

6. The connector according to claim 2, wherein the core wire caulked portion is disposed between the protruding line portions.

7. The connector according to claim 1, further comprising a recessed portion opposite surface formed continuous with the bottom surfaced of the recessed clearance portion, and the bottom surface has a first inclination angle and the recessed portion opposite surface has a second inclination angle, in which the first inclination angle is different than the second inclination angle.

* * * * *